US009844941B2

(12) United States Patent
Miyajima

(10) Patent No.: US 9,844,941 B2
(45) Date of Patent: Dec. 19, 2017

(54) LIQUID EJECTING HEAD AND LIQUID EJECTING APPARATUS

(71) Applicant: SEIKO EPSON CORPORATION, Tokyo (JP)

(72) Inventor: Hiroki Miyajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/434,686

(22) Filed: Feb. 16, 2017

(65) Prior Publication Data

US 2017/0246868 A1 Aug. 31, 2017

(30) Foreign Application Priority Data

Feb. 26, 2016 (JP) ..... 2016-035216
Jan. 19, 2017 (JP) ..... 2017-007224

(51) Int. Cl.
*B41J 2/14* (2006.01)
*B41J 2/165* (2006.01)
*B41J 29/13* (2006.01)

(52) U.S. Cl.
CPC ..... *B41J 2/165* (2013.01); *B41J 2/14* (2013.01); *B41J 2/1429* (2013.01); *B41J 2/1433* (2013.01); *B41J 2/14201* (2013.01); *B41J 29/13* (2013.01)

(58) Field of Classification Search
CPC ..... B41J 2/14; B41J 2/14201; B41J 2/1429; B41J 2/1433; B41J 2/165; B41J 2002/14306; B41J 2002/14362; B41J 29/13
See application file for complete search history.

(56) References Cited

U.S. PATENT DOCUMENTS 5,907,340 A * 5/1999 Katakura ..... B41J 2/14233 347/70
8,496,316 B2 * 7/2013 Suzuki ..... B41J 2/155 347/44
9,302,480 B2 * 4/2016 Enomoto ..... B41J 2/14201
2014/0292953 A1 10/2014 Kinoshita et al.

FOREIGN PATENT DOCUMENTS

JP 2015-051623 A 3/2015

* cited by examiner

*Primary Examiner* — Anh T. N. Vo
(74) *Attorney, Agent, or Firm* — Foley & Lardner LLP

(57) ABSTRACT

A liquid ejecting head includes a first case that houses a flow path member that is provided with a liquid flow path, a second case that includes a head unit, a seal member that includes a connecting portion that seals and liquid-tightly connects the liquid flow path on a first case side and a liquid flow path on a second case side. The liquid ejecting head ejects a liquid supplied from the flow path member from a nozzle of the head unit. A flow path-isolating member having higher gas barrier property than the seal member is disposed between the first case and the seal member. The flow path member is disposed in a sealed space that is defined in the first case by a flow path-isolating member being joined to the first case.

14 Claims, 8 Drawing Sheets

LIQUID EJECTING HEAD AND LIQUID EJECTING APPARATUS

BACKGROUND

1. Technical Field

The present invention relates to a liquid ejecting head, such as an ink jet type recording head, and a liquid ejecting apparatus that includes the liquid ejecting head. More particularly, the invention relates to a liquid ejecting head that includes a flow path member in which a plurality of flow path component members are stacked and to a liquid ejecting apparatus that includes the liquid ejecting head.

2. Related Art

A liquid ejecting apparatus is an apparatus that is equipped with a liquid ejecting head and that ejects (discharges) various liquids from the ejecting head. Examples of the existing liquid ejecting apparatus are image recording apparatuses such as ink jet type printers and ink jet type plotters. In recent years, the liquid ejecting apparatus is applied to various production apparatuses by utilizing the advantage of being capable of accurately landing very small amounts of liquid at predetermined locations. Examples of such applications include a display production apparatus that produces a color filter of a liquid crystal display and the like, an electrode forming apparatus that forms electrodes of organic electro-luminescence (EL) displays, field emission displays (flat panel displays), etc., and chip production apparatuses that produce biochips (biochemical devices). The recording head for an image recording apparatus ejects an ink in a liquid state, and the color material ejecting head for a display production apparatus ejects solutions of color materials of red (R), green (G), and blue (B). Furthermore, the electrode material ejecting head for an electrode forming apparatus ejects an electrode material in a liquid state, and the bioorganic material ejecting head for a chip production apparatus ejects a solution of a bioorganic material.

The liquid ejecting head introduces a liquid from a liquid supply source in which the liquid is stored, and ejects the liquid in the form of droplets from the nozzles by driving drive elements such as piezoelectric elements, heating elements, etc. A certain liquid ejecting head includes liquid flow paths constructed of a plurality of stacked component parts. For example, in a liquid ejecting head described in JP-A-2015-051623, flow path members that include a first flow path member, a filter, and a second flow path member are housed within an upper/lower case member that includes an upper case member and a lower case member. Furthermore, a seal member (bush) made of an elastic material is provided between a lower case member and a flow path portion that includes the upper case member and a flow path member. This seal member provides liquid-tight communication between a flow path of a flow path portion side and a flow path of a lower case member side via a through opening of the seal member. In this construction, the seal member is provided with an atmospherically open path that provides communication between a space on an inner periphery side of the seal member and the atmosphere on an outer periphery side of the seal member. Therefore, a space on a lower side of the seal member and a space formed between the seal member and the flow path portion are open to the atmosphere through the atmospherically open path. This atmospherically open path is formed by a thin groove formed on an upper surface of an annular seal site of the seal member and the flow path member in close contact with the upper surface of the annular seal site.

In the foregoing construction, the upper case member is merely fixed to the lower case member by performing, for example, screwing or crimping, from a lower portion of the case. Therefore, gas tightness and liquid tightness of the interior of the upper/lower case member are not secured. Furthermore, because a common elastomer used for the seal member is not an elastomer enhanced in gas barrier property, moisture (a solvent component) in a liquid flow path passes in the form of vapor through the material of the seal member in addition to the foregoing atmospherically open path and diffuses into the atmosphere. Therefore, there is a problem that the thickening (viscosity increase) of the liquid in the liquid flow path of the flow path member in particular progresses.

SUMMARY

An advantage of some aspects of the invention is that a liquid ejecting head and a liquid ejecting apparatus that are capable of inhibiting the thickening of a liquid in a liquid flow path of a flow path member are provided.

A liquid ejecting head according to one aspect of the invention includes a first case that houses a flow path member that is provided with a liquid flow path, a second case that includes a head unit, a seal member that includes a connecting portion that seals and liquid-tightly connects the liquid flow path on a first case side and a liquid flow path on a second case side. The liquid ejecting head ejects a liquid supplied from the flow path member from a nozzle of the head unit. A flow path-isolating member having higher gas barrier property than the seal member is disposed between the first case and the seal member. The flow path member is disposed in a sealed space that is defined in the first case by a flow path-isolating member being joined to the first case.

According to this aspect of the invention, because the flow path member is disposed in the sealed space that is defined in the first case as the flow path-isolating member having high gas barrier property is joined to the first case, evaporation of moisture (a solvent component) of the liquid in the liquid flow path of the flow path member disposed in the sealed space is inhibited. This inhibits the thickening of the liquid present in the liquid flow path of the flow path member.

In the foregoing construction, the first case may have higher gas barrier property than the seal member.

According to this construction, because the sealed space is defined as the flow path-isolating member is joined to the first case having higher gas barrier property than the seal member, evaporation of moisture of the liquid in the liquid flow path of the flow path member disposed in the sealed space is inhibited more surely.

In the foregoing construction, the seal member may have an outside wall along an outer perimeter of the seal member, and a space in which the connecting portion is disposed may be sealed by placing the outside wall in close contact with the flow path-isolating member and a component member on the second case side.

According to this construction, because the space in which the connecting portion is disposed is sealed as the seal member outside wall is in close contact with the flow path-isolating member and the second case-side component member, that is, because the connecting portion between the first case-side liquid flow path and the second case-side liquid flow path is double-sealed, moisture (a solvent) of the liquid in the liquid flow path is inhibited from evaporating from the connecting portion between the first case-side liquid flow path and the second case-side liquid flow path.

In the foregoing construction, a portion of the flow path-isolating member which contacts the outside wall of the seal member may be provided with a groove extending along the outer perimeter, and a resistance pathway may be formed by the portion having contact with the outside wall. The resistance pathway may communicate with the sealed space and also communicate with an atmospherically open path that connects to an atmosphere.

According to this construction, because the resistance pathway both restrains moisture evaporation from the liquid flow path in the sealed space (maintains a high-humidity state) and allows the sealed space to be open to the atmosphere, pressure changes in the sealed space can be reduced.

In the foregoing construction, the first case may include a positioning pin that defines a position at which the flow path member is disposed. The flow path member may have an insertion hole into which the positioning pin is inserted. The flow path-isolating member may have a recess portion into which a distal end portion of the positioning pin fits. The positioning pin may be covered by the flow path member and the flow path-isolating member and disposed in the sealed space by inserting the positioning pin through the insertion hole and fitting the positioning pin into the recess portion.

According to this construction, because the positioning pin is disposed in the sealed space in a state in which the positioning pin is covered by the flow path member and the flow path-isolating member by inserting the positioning pin into the insertion hole and fitting it into the recess portion, the sealed space is prevented from communicating with the atmosphere via the insertion hole in which the positioning pin is inserted, so that it becomes possible to position the flow path member and the flow path-isolating member by the positioning pin while securing gas tightness and liquid tightness of the sealed space.

Furthermore, in the foregoing construction, the first case may have a positioning pin that defines a position at which the flow path member is disposed. The flow path member and the flow path-isolating member may each have an insertion hole into which the positioning pin is inserted. The positioning pin may be inserted in the insertion hole and disposed in the sealed space, and a distal end portion of the positioning pin exposed via the insertion hole may be sealed by a sealer.

According to this construction, because the positioning pin is disposed in the sealed space in a state in which the positioning pin is inserted in the insertion hole and the distal end portion exposed via the insertion hole is sealed by the sealer, the sealed space is prevented from communicating with the atmosphere via the insertion holes in which the positioning pin is inserted, so that it becomes possible to position the flow path member and the flow path-isolating member by the positioning pin while securing gas tightness and liquid tightness of the sealed space.

In the foregoing construction, the flow path member may be formed by stacking a plurality of flow path component members. One of the flow path component members may be the flow path-isolating member.

According to this construction, because one of the flow path component members is a flow path-isolating member, it is unnecessary to provide a flow path-isolating member separately from the flow path component members that constitute the flow path member and therefore it becomes possible to reduce the size of the liquid ejecting head. The material cost can also be reduced.

A liquid ejecting apparatus according to another aspect of the invention includes a liquid ejecting head having any one of the foregoing construction.

According to this liquid ejecting apparatus, because the thickening of liquid in the flow path member is inhibited, changes in ink ejection characteristics, such as the weight of liquid ejected from the nozzle and the flying speed of ejected liquid, caused by the thickening of liquid are inhibited. Therefore, the reliability of the liquid ejecting apparatus improves. Furthermore, it becomes possible to reduce the amount of liquid consumed in a maintenance operation of discharging thickened liquid from the nozzle by performing liquid suction while having a nozzle surface of the liquid ejecting head sealed by a cap.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will be described hereinafter with reference to the accompanying drawing. Although the exemplary embodiments described below are limited in various manners as preferred concrete examples of the invention, the scope of the invention is not limited to such various manners and forms unless it is mentioned in the following description that the invention is limited in a particularly manner. Furthermore, in the following description, the liquid ejecting apparatus of the invention will be described in conjunction with an example of an ink jet type printer (hereinafter, referred to simply as printer 1) that includes an ink jet type recording head (hereinafter, referred to simply as recording head 3) that is a type of liquid ejecting head.

Figure 1:
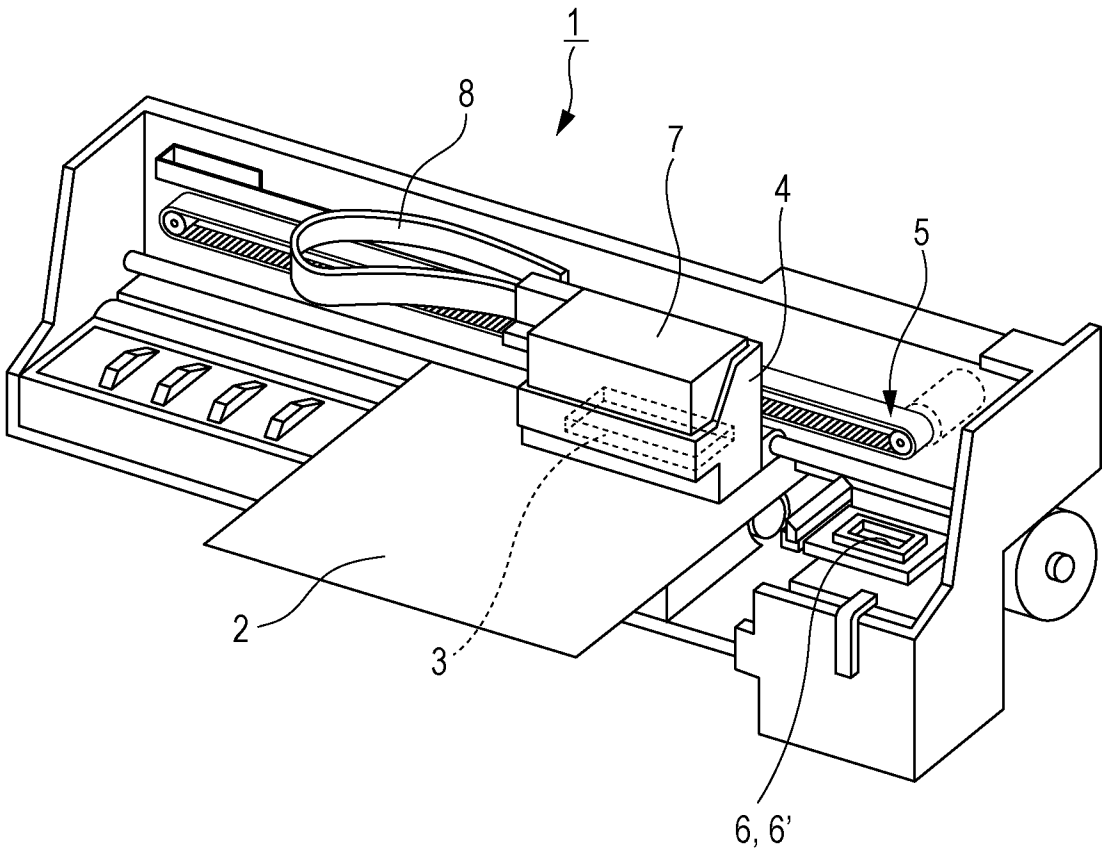
FIG. 1 is a perspective view illustrating a construction of a liquid ejecting apparatus (printer).

First, a construction of the printer 1 according to an exemplary embodiment of the invention will be described with reference to FIG. 1. The printer 1 is an apparatus that performs recording of an image or the like by ejecting an ink in a liquid state onto a surface of a recording medium 2 such as a recording sheet or the like. This printer 1 includes a recording head 3, a carriage 4 on which the recording head 3 is mounted, and a carriage moving mechanism 5 that moves the carriage 4 in a main scanning direction. Furthermore, the printer 1 includes a transporting mechanism that transports the recording medium 2 in a subsidiary scanning direction. Note that the foregoing ink is a kind of liquid in the invention and is stored in an ink cartridge 7 as a liquid supply source or a liquid storing container. This ink cartridge 7 is detachably fitted to the recording head 3. It is also possible to adopt a construction in which an ink cartridge 7 is disposed on a main body of the printer 1 and the ink in the ink cartridge 7 is supplied to the recording head 3 through an ink supply tube.

In the printer 1, a home position that is a standby position of the carriage 4 is set on an end side of the carriage 4 in the main scanning direction. A capping mechanism 6 (a kind of a maintenance mechanism) is disposed at the home position. The capping mechanism 6 includes a tray shaped cap 6' (sealing member) that can contact a nozzle surface that is provided with nozzles 75 (see FIG. 9) of the recording head 3. This capping mechanism 6 is constructed so that an opening formed on an upper surface side of the cap 6' will face the nozzles 75 of the recording head 3 when the cap 6' has close contact with the nozzle surface. By making the sealed state in which the cap 6' is in close contact with the nozzle surface, a sealed cavity is defined in the cap 6'. A pump unit (not graphically shown) is connected to the cap 6'. The pump unit includes a suction pump, for example, a tube pump or the like, and is capable of producing negative pressure in the sealed cavity by operating the suction pump. When, during the state of close contact with the nozzle surface, the suction pump is operated to produce negative pressure in the sealed cavity (enclosed space), ink and air bubbles in the recording head 3 are sucked out through the nozzles 75 and discharged into the sealed cavity of the cap 6'. That is, this capping mechanism 6 performs a cleaning operation that is a kind of maintenance operation of forcing air bubbles or thickened ink to be sucked and discharged out of the ink flow path of the recording head 3.

Figure 2:
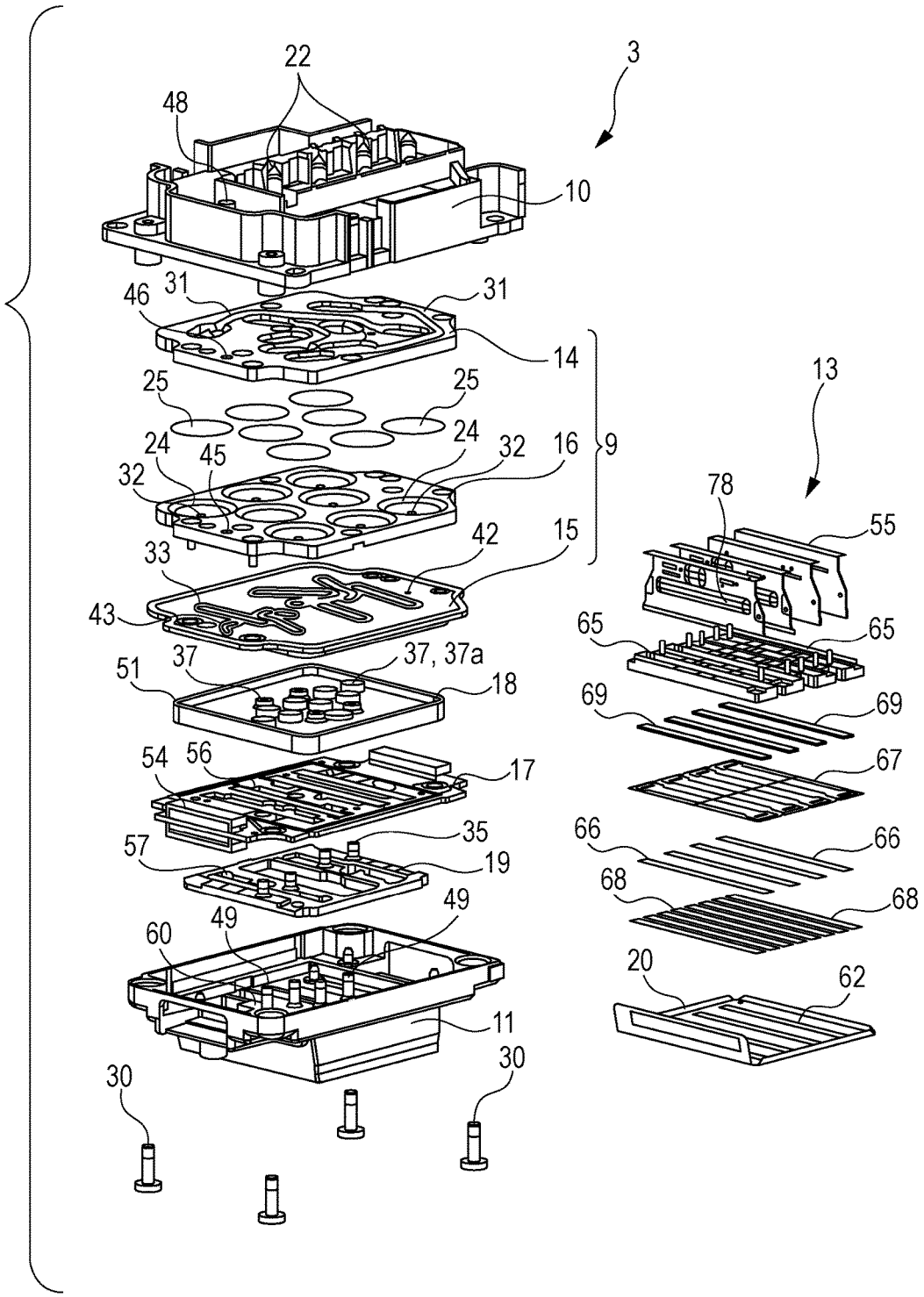
FIG. 2 is an exploded perspective view of a liquid ejecting head (recording head).
Figure 3:
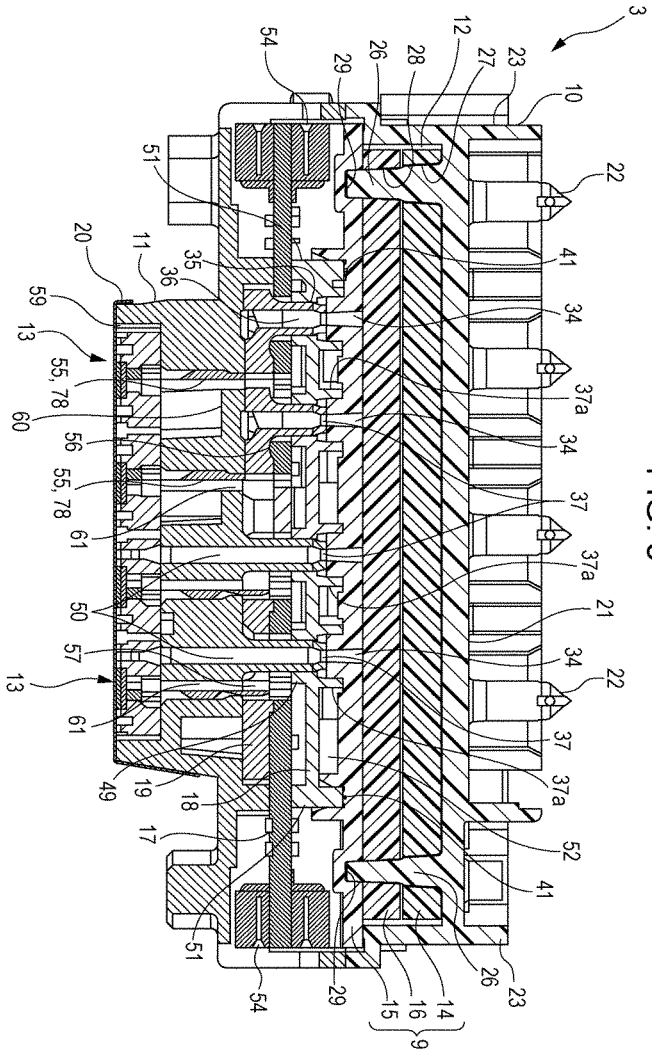
FIG. 3 is a sectional view of the liquid ejecting head.

FIG. 2 is an exploded perspective view showing a construction of the recording head 3. FIG. 3 is a sectional view of the recording head 3. In the following description, the nozzle surface of the recording head 3 is used as a reference surface and the direction orthogonal to the nozzle surface is assumed to be an up-down direction. In this exemplary embodiment, the recording head 3 includes a first case 10 on an upper side and a second case 11 on a lower side. Inside the first case 10 and the second case 11, a flow path member 9, a seal member 18, a circuit board 17, a flow path-connecting member 19, a plurality of head units 13, etc. are stacked and houses. Furthermore, the flow path member 9 is made up by stacking a plurality of flow path component members, concretely, a first flow path member 14, a filter substrate 16, and a second flow path member 15. The first case 10 and the second case 11, housing therein the foregoing component members, are fixed to each other by, for example, a fastening member 30 such as a screw, a crimp pin, etc.

The first case 10 is a member from which a plurality of introduction pins 22 stand. The first case 10 is produced from, for example, a synthetic resin whose gas barrier property has been enhanced as compared with the seal member 18, such as a modified polyphenylene ether containing a glass filler (modified PPE: ZYLON (registered trademark)) or the like. Furthermore, in this exemplary embodiment, the various flow path component members (the first flow path member 14, the filter substrate 16, and the second flow path member 15) that constitute the flow path member 9 are also each manufactured from a synthetic resin having an enhanced gas barrier property compared to the seal member 18. Incidentally, it suffices that, of the flow path component members of the flow path member 9, the second flow path member 15 is manufactured from a synthetic resin having an enhanced gas barrier property compared to the seal member 18, and the other flow path component members do not necessarily need to be made of a synthetic resin having an enhanced gas barrier property.

In this exemplary embodiment, a total of four introduction pins 22 corresponding to the different color inks of ink cartridges 7 are provided side by side along the scanning direction of the recording head 3 on an upper surface of an introduction pin baseboard 21 of the first case 10. These introduction pins 22 are hollow needle-shaped members that are inserted into the ink cartridges 7 so as to introduce the inks stored in the ink cartridges 7 to a first flow path member 14 side through internal needle flow paths (not graphically shown). Incidentally, the construction for introducing the inks from the ink cartridges 7 into the recording head 3 is not limited to one that employs introduction pins 22 but may also be, for example, a construction in which, for each ink, the ink supply side and the ink reception side are each provided with a porous member capable of absorbing the ink and the porous members are placed in contact with each other to supply and receive the ink.

Furthermore, as shown in FIG. 3, as for the first case 10 in this exemplary embodiment, four-side edges of the introduction pin baseboard 21 are provided with side walls 23 that extend downward (to the second case 11 side). In a space enclosed by the side walls 23 and the introduction pin baseboard 21, the first flow path member 14 and the filter substrate 16, of the aforementioned flow path component members of the flow path member 9, are housed. The second flow path member 15 (a kind of a flow path-isolating member in the invention) is joined by an adhesive to lower ends of the side walls 23 so as to close a lower surface-side opening of the space in which the first flow path member 14 and the filter substrate 16 are housed. This adhesive is one that is capable of securing gas and liquid tightness of the joining portions, for example, an epoxy-based adhesive. Thus, the first case 10 and the second flow path member 15 define a sealed space 12 that is isolated from external air. Therefore, liquid flow paths within the flow path member 9 (series of flow paths that include guide flow paths 31, filter chambers 24, and supply flow paths 33 which will be described below) are housed in the sealed space 12. This sealed space 12 functions as a moisture evaporation management space that inhibits moisture that has penetrated through portions of wall surfaces that form internal liquid flow paths from excessively evaporating from the internal liquid flow paths. Incidentally, the sealed space 12 is not a completely tightly closed space but is open to the atmosphere through an atmospherically open passageway that will be described later. A resistance pathway that forms a portion of the atmospherically open passageway inhibits evaporation of moisture from the flow paths while allowing the sealed space 12 to be open to the atmosphere. This will be described later.

Figure 4:
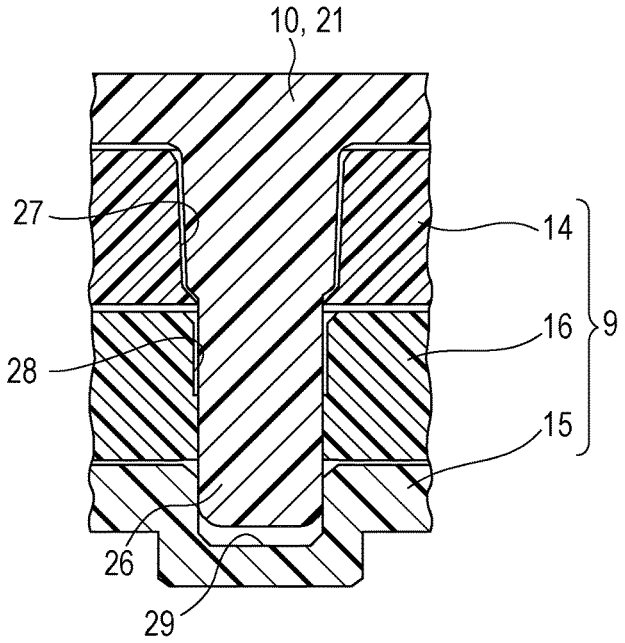
FIG. 4 is a sectional view of a positioning pin and its surroundings.

FIG. 4 is a sectional view of a positioning pin 26 and its surroundings. A plurality of positioning pins 26 are protruded downward (to the second case 11 side) from a lower surface of the introduction pin baseboard 21 of the first case 10. These positioning pins 26 define the relative position of the flow path member 9 in directions orthogonal to the stacking direction of the flow path component members of the flow path member 9. Correspondingly, the first flow path member 14 is provided with positioning holes 27 (corresponding to an insertion hole in the invention) which penetrate through the first flow path member 14 in its plate thickness direction and through which the positioning pins 26 can be inserted. Likewise, the filter substrate 16 is also provided with positioning holes 28 (corresponding to an insertion hole in the invention) which penetrates through the filter substrate 16 in its plate thickness direction and through which the positioning pins 26 can be inserted. On the other hand, the second flow path member 15 in this exemplary embodiment is provided with positioning recess portions 29 (corresponding to a recess portion in the invention) into which distal end portions of the positioning pins 26 can be fitted. That is, the positioning recess portions 29 extend in a hollow shape from positions on an upper surface (first case 10-side surface) of the second flow path member 15 which correspond to the positions of the distal end portions of the positioning pins 26 toward a lower surface (second case 11-side surface) of the second flow path member 15 in the thickness direction of the second flow path member 15 without penetrating through the second flow path member 15. As the first flow path member 14, when the filter substrate 16, and the second flow path member 15 are stacked in a state in which the positioning pins 26 are inserted through the positioning holes 27 and 28 of the first flow path member 14 and the filter substrate 16 and their distal end portions are fitted into the positioning recess portions 29 of the second flow path member 15, the relative positions of these flow path component members are fixed. The positioning pins 26 are disposed in the sealed space 12, in a state in which the positioning pins 26 are covered by the first flow path member 14, the filter substrate 16, and the second flow path member 15. Therefore, communication of the sealed space 12 with the atmosphere through the positioning holes 27 and 28 into which the positioning pins 26 are inserted is prevented. Thus, it is possible to define the positions of the flow path component members by the positioning pins 26 while securing gas and liquid tightness of the sealed space 12.

The first flow path member 14, which is one of the flow path component members, is a member made of a synthetic resin that is provided with a plurality of guide flow paths 31 corresponding to the introduction pins 22. The guide flow paths 31 guide the inks introduced through the introduction pins 22 to filter chambers 24 (described later) of the filter substrate 16. The guide flow paths 31 communicate with the corresponding introduction pins 22 on the upper surface of the first flow path member 14. Furthermore, each guide flow path 31 extends in a planar direction of the first flow path member 14 independently of the other guide flow paths 31 without intersecting the other guide flow paths 31, and divides midway into two branch flow paths. The branch flow paths of each guide flow path 31 have separate openings in the lower surface of the first flow path member 14 and communicate with two filter chambers 24. In this exemplary embodiment, corresponding to the four introduction pins 22, a total of eight branch flow paths are formed in the first flow path member 14.

The filter substrate 16, which is one of the flow path component members, is provided with the filter chambers 24 in each of which a filter 25 is disposed. Each filter chamber 24 is a cavity whose upper surface side has an opening. In a bottom portion of each filter chamber 24, a filter 25 is fixed. Each filter 25 filters ink flowing down through a corresponding one of ink flow paths and is, for example, a filter formed by finely weaving a metal into a mesh shape or a filter provided with many through holes formed by the plastic working of a thin metal sheet. When ink is contaminated with bubbles or undesired matter, the bubbles or the undesired matter is trapped in the filter chambers 24 by the filters 25 and therefore prevented from flowing into the head unit 13 side. Furthermore, the bottom portion of each filter chamber 24 has an opening of an outlet 32. The outlets 32 communicate with supply flow paths 33 in the second flow path member 15 at the lower surface of the filter substrate 16.

The second flow path member 15, which is one of the flow path component members and a kind of flow path-isolating member, is a member provided with a plurality of supply flow paths 33 that supply the inks introduced from the filter chamber 24 side into head flow paths of the head units 13. In this exemplary embodiment, a total of eight supply flow paths 33 extend independently of each other in planar directions of the second flow path member 15 without intersecting with each other. Each of the supply flow paths 33 of the second flow path member 15 communicates with the outlet 32 of a corresponding one of the filter chambers 24 at the upper surface of the second flow path member 15 and communicates with a communication opening 34 that penetrates through the second flow path member 15 in its plate thickness direction. Some of the communication openings 34 communicate with connection flow paths 36 in flow path-connecting portions 35 of a flow path-connecting member 19 through communication holes 37 of a seal member 18, and also communicates with introduction flow paths 50 of the second case 11 through the connection flow paths 36. The other communication openings 34 communicate with the introduction flow paths 50 by communicating with introduction portions 49 of the second case 11 through the communication holes 37 of the seal member 18. That is, the seal member 18 liquid-tightly seals the liquid flow paths of the first case 10 side and the liquid flow paths of the second case 11 sides and thus provides communication therebetween. Note that the flow paths upstream of the communication holes 37 of the seal member 18 assumed as a boundary are considered the first case 10-side flow paths and the flow paths downstream of the communication holes 37 are considered the second case 11-side liquid flow paths. Furthermore, portions of the seal member 18 where the first case 10-side liquid flow paths and the second case 11-side liquid flow paths are connected by the communication holes 37 correspond to a connecting portion in the invention.

Figure 5:
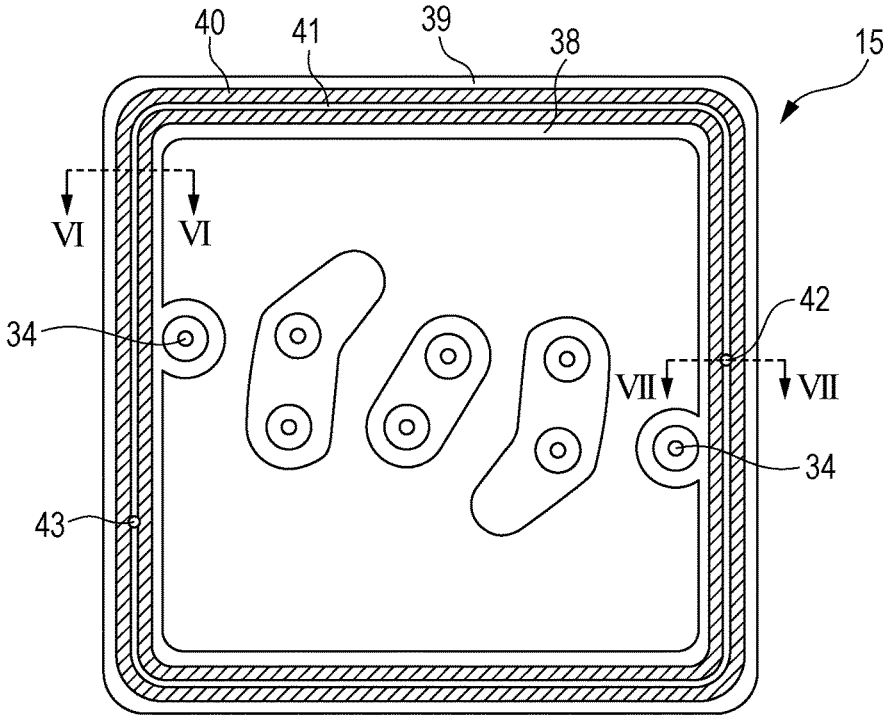
FIG. 5 is a bottom plan view of a second flow path member.
Figure 6:
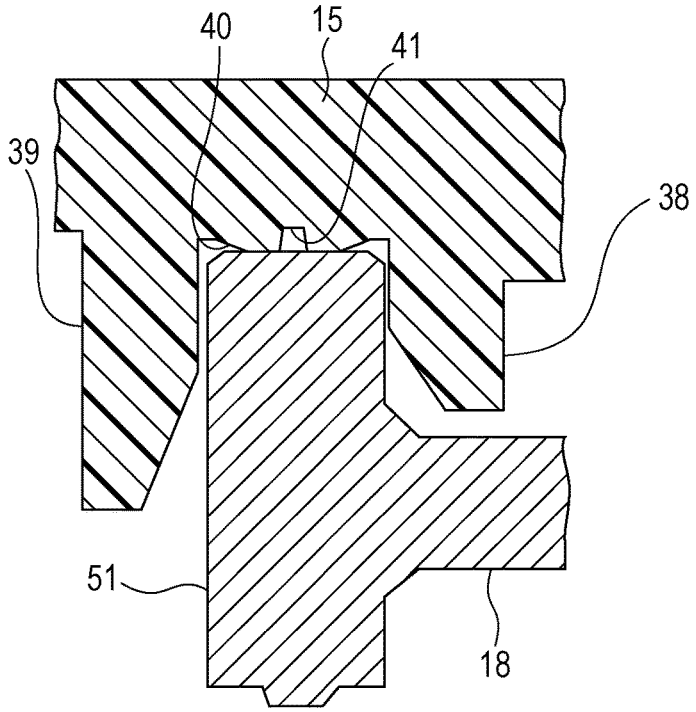
FIG. 6 is a sectional view taken along line VI-VI in FIG. 5.
Figure 7:
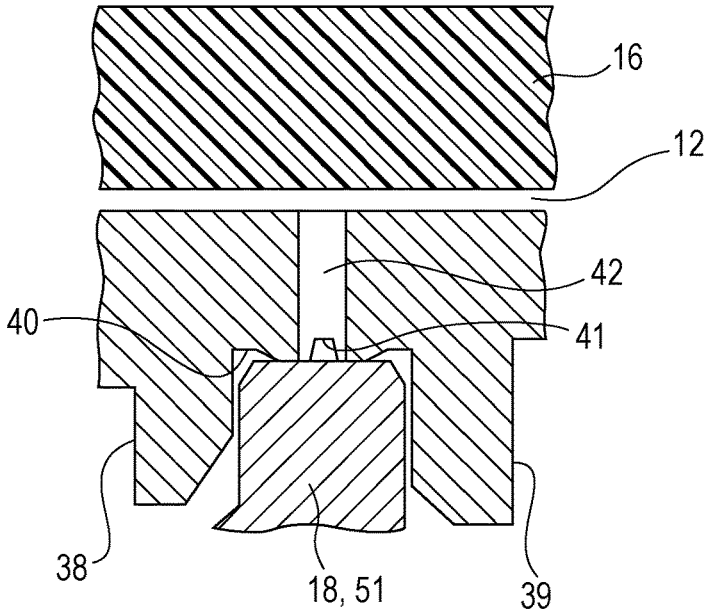
FIG. 7 is a sectional view taken along line VII-VII in FIG. 5.

FIG. 5 is a bottom plan view of the second flow path member 15. FIG. 6 is a sectional view taken along line VI-VI in FIG. 5. FIG. 7 is a sectional view taken along line VII-VII in FIG. 5. On the lower surface of the second flow path member 15, a first perimeter wall 38 extends downward (to the second case 11 side) so as to surround a region in which the communication openings 34 are formed, and a second perimeter wall 39 similarly extends but is spaced outward by a predetermined interval from the first perimeter wall 38. A trench formed along an outer perimeter of the second flow path member 15 between the first perimeter wall 38 and the second perimeter wall 39 (a portion indicated by hatching in FIG. 5) functions as a fitting portion 40 into which an outside wall 51 of the seal member 18 is fitted. The fitting portion 40 is provided with an elongated narrow groove 41 extending along the extending directions of the fitting portion 40. As shown in FIG. 6, the groove 41 defines a resistance pathway that is a portion of an atmospherically open passageway as the outside wall 51 of the seal member 18 is fitted to the fitting portion 40 so that an upper end surface of the outside wall 51 is in contact with the fitting portion 40. This resistance pathway is a passageway whose cross-sectional area and length are predetermined so as to provide resistance to passage of moisture. The groove 41 has a first through opening 42 and a second through opening 43 that are formed at different locations. The first through opening 42 and the second through opening 43 are through holes that penetrate through the second flow path member 15 in its thickness direction. As shown in FIG. 7, the first through opening 42 communicates with the sealed space 12 in which the first flow path member 14 and the filter substrate 16 are disposed. That is, the sealed space 12 communicates with an atmospherically open passageway through the first through opening 42.

Figure 8:
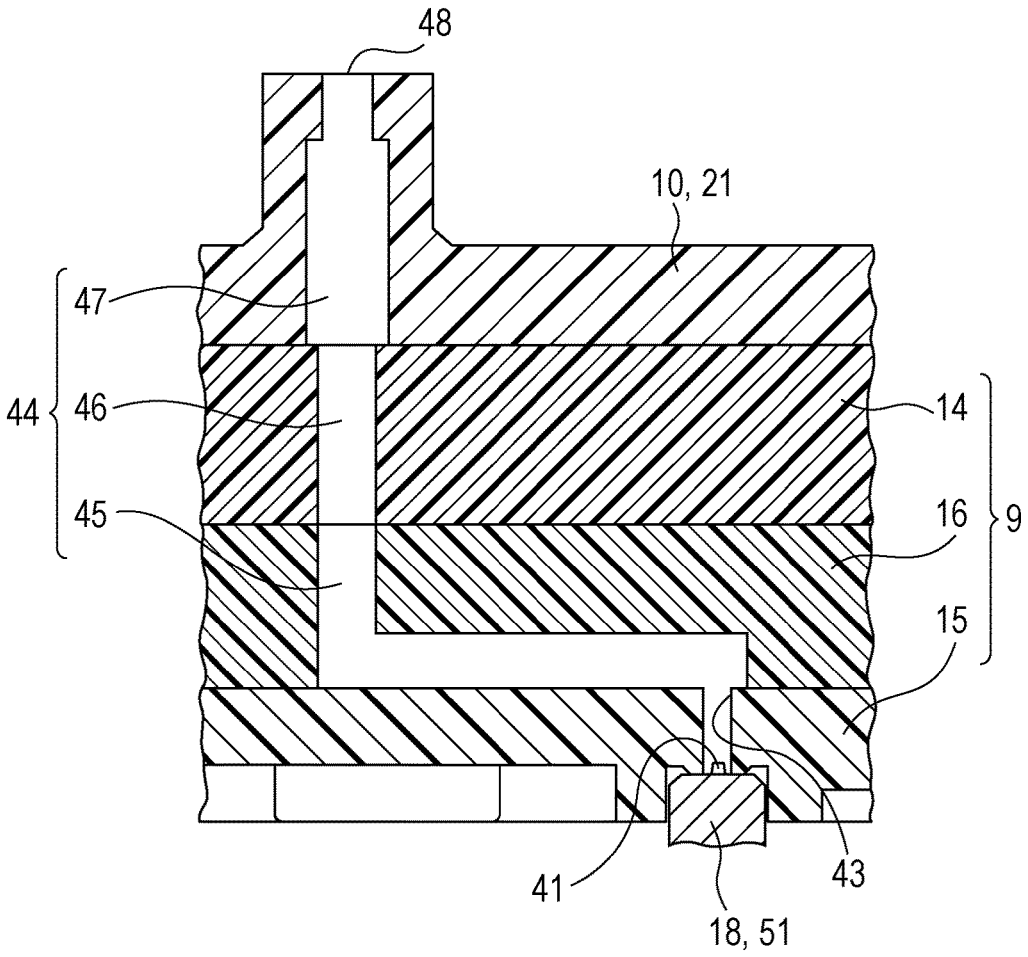
FIG. 8 is a sectional view illustrating an atmospherically open passageway of a first case and of flow path members.

FIG. 8 is a sectional view illustrating the atmospherically open passageway of the first case 10 and the flow path member 9. The second through opening 43 communicates with an atmospherically open path 44 that is formed in the filter substrate 16, the first flow path member 14, and the first case 10. The atmospherically open path 44 is a portion of an atmospherically open passageway which is formed by series connection of a first atmospheric communication path 45 provided in the filter substrate 16, a second atmospheric communication path 46 provided in the first flow path member 14, and a third atmospheric communication path 47 of the introduction pin baseboard 21 of the first case 10. The passageway cross-sectional area of the atmospherically open path 44 is set sufficiently larger than the passageway cross-sectional area of the aforementioned resistance pathway. Furthermore, one end of the atmospherically open path 44 communicates with the second through opening 43 and another end thereof opposite to that one end communicates with the atmosphere through the through the atmospheric opening 48 of the first case 10. Thus, the sealed space 12, communicating with the first through opening 42 and the resistance pathway, further communicates with the second through opening 43 and the atmospherically open path 44 and is open to the atmosphere through the atmospheric opening 48. This makes it possible to reduce pressure changes in the sealed space 12 while restraining moisture evaporation from the liquid flow paths provided in the sealed space 12 (i.e., while maintaining a high-humidity state).

The seal member 18, the circuit board 17, and the flow path-connecting member 19 are disposed between the second flow path member 15 of the first case 10 and the second case 11. The seal member 18 is a member manufactured from, for example, an elastic material such as an elastomer, and is provided with the communication holes 37 having openings at positions that correspond to the positions of the communication openings 34 of the second flow path member 15. The communication holes 37 are disposed between lower end openings of the communication openings 34 of the second flow path member 15 and upper end openings of the introduction portions 49 of the second case 11 or between lower end openings of the communication openings 34 and flow path-connecting portions 35 of the flow path-connecting member 19, that is, disposed between first case 10-side liquid flow paths and second case 11-side liquid flow paths. As peripheral edge portions of openings of the communication holes 37 elastically closely contact peripheral edge portions of openings of the foregoing flow paths and thus achieves sealing, the first case 10-side liquid flow paths and the second case 11-side liquid flow paths communicate with each other in a liquid tight state. The upper and lower opening peripheral edge portions of each communication hole 37 are provided with a hollow cylindrical enclosing wall 37*a* (see FIG. 2 and FIG. 3) that is protruded to the first case 10 side and to the second case 11 side. Upper end surfaces and lower end surfaces of the enclosing walls 37*a* closely contact the second flow path member 15 and the circuit board 17, respectively, and therefore seal connecting portions between the first case 10-side liquid flow paths and the second case 11-side liquid flow paths.

Furthermore, the outer peripheral edge of the seal member 18 is provided with the outside wall 51 extending from the outer peripheral edge to the first case 10 side and to the second case 11 side. When the seal member 18 is positioned and disposed between the second flow path member 15 and the circuit board 17, the upper end portion of the outside wall 51 fits to the fitting portion 40 of the second flow path member 15 and contacts a portion of the second flow path member 15 which is provided with the groove 41, so that the foregoing resistance pathway is formed. The lower end portion of the outside wall 51 contacts the upper surface of the second circuit board 17. When the component members of the recording head 3 are stacked and assembled, the outside wall 51 of the seal member 18 is squeezed between the second flow path member 15 and the circuit board 17 and, due to its elasticity, closely contacts the second flow path member 15 and the circuit board 17. Due to this, a flow path-connecting space 52 (see FIG. 3) in which connecting portions between the first case 10-side liquid flow paths and the second case 11-side liquid flow paths is sealed by the outside wall 51 of the seal member 18 in a manner in which the outside wall 51 surrounds and encloses the flow path-connecting space 52. That is, the connecting portions between the first case 10-side liquid flow paths and the second case 11-side liquid flow paths are double-sealed. This inhibits evaporation of moisture (a solvent) of ink from the connecting portions between the first case 10-side liquid flow paths and the second case 11-side liquid flow paths. Furthermore, in this exemplary embodiment, the connecting portions are further (triply) sealed by the enclosing wall 37*a* and the outside wall 51, so that the evaporation of moisture (a solvent) of the inks in the liquid flow paths from the connecting portions is effectively inhibited.

The circuit board 17 is a so-called printed board. The circuit board 17 in this exemplary embodiment includes a connector 54 to which a flexible flat cable (FFC) 8 (see FIG. 1) extending from the printer main body side is connected. The circuit board 17 receives control signals, such as drive signals, from the printer main body side through this FFC 8 and applies the signals to piezoelectric elements 71 (see FIG. 9) of the head unit 13 through flexible boards 55. That is, the circuit board 17 is a board that relays drive signals for driving the piezoelectric elements 71 as drive elements (active elements). The connector 54 is disposed at an outer side of the location at which a lower end surface of the outside wall 51 of the seal member 18 contacts the circuit board 17 to achieve the sealing. This allows the FFC 8 to be inserted into and pulled out from the connector 54 while maintaining the sealed state of the flow path-connecting space 52 in which the foregoing connecting portions are disposed. This circuit board 17 is provided with escape holes 56 through which the flexible boards 55, the introduction portions 49 of the second case 11, and the flow path-connecting portions 35 of the flow path-connecting member 19 are inserted. The circuit board 17 is disposed in the second case 11, with the flow path-connecting member 19 interposed therebetween, in a state in which the circuit board 17 closes an upper surface-side opening above a region inside the second case 11 in which the flow path-connecting member 19 is disposed.

The flow path-connecting member 19 is a member made of a synthetic resin which is disposed between the circuit board 17 and the second case 11. In this exemplary embodiment, an upper surface of the flow path-connecting member 19 is provided with a plurality of protruded hollow cylindrical flow path-connecting portions 35. The recording head 3 in this exemplary embodiment is provided with a total of eight nozzle rows of which four nozzle rows correspond to a total of four flow path-connecting portions 35 provided on the flow path-connecting member 19. As described above, each flow path-connecting portion 35 has therein a connection flow path 36. An end of each connection flow path 36 communicates with a corresponding one of the communication openings 34 of the second flow path member 15 through a corresponding one of the communication holes 37 of the seal member 18 as described above. Another end of each connection flow path 36 communicates with a corresponding one of the introduction flow paths 50 through a planar flow path (not graphically shown) that extends in parallel with a nozzle surface of the second case 11. Furthermore, the flow path-connecting member 19 is provided with escape holes 57 through which the flexible boards 55 and the introduction portions 49 of the second case 11 are inserted.

The second case 11 is a box-shaped member that houses a plurality of head units 13 in a housing chamber 59 formed therein. In the second case 11, the introduction flow paths 50 that communicate with case flow paths 64 (described later) in the head units 13 inside the housing chamber 59 are formed corresponding to the nozzle rows of the head units 13. Furthermore, the second case 11 is divided by a dividing wall 60 into upper and lower regions, that is, a region in which the flow path-connecting member 19 is disposed and a region in which the housing chamber 59 is formed. On an upper surface of the dividing wall 60, a total of four protruded hollow cylindrical introduction portions 49 corresponding to the other four rows of the foregoing eight nozzle rows are provided as upper end portions of the introduction flow paths 50. The introduction portions 49 communicate with the communication openings 34 of the second flow path member 15 through the communication holes 37 of the seal member 18 as described above. The flow path-connecting member 19 is disposed on the upper surface of the dividing wall 60 in a state in which the introduction portions 49 are inserted through the escape hole 57 of the flow path-connecting member 19. Furthermore, the planar flow path has an end opening in the dividing wall 60 and that opening portion communicates with the connection flow paths 36 of the flow path-connecting member 19. The dividing wall 60 further has board insertion openings 61 into which the flexible boards 55 are inserted. An end of each flexible board 55 is connected to the piezoelectric elements 71 of a corresponding one of the head units 13, and another end thereof is passed through corresponding ones of the board insertion openings 61 and the escape holes 56 and 57, drawn out onto the upper surface side of the circuit board 17, and electrically connected to terminals of the circuit board 17.

The housing chamber 59 of the second case 11 has an opening on a lower surface side of the second case 11. In this exemplary embodiment, the housing chamber 59 houses a total of four head units 13 positioned and aligned in a direction that corresponds to the main scanning direction. Incidentally, in the invention, the number of head units 13 housed in the housing chamber 59 is not limited to four. Lower surfaces of the head units 13 in the housing chamber 59 (more concretely, lower surfaces of compliance substrates 68 described later) are fixed by an adhesive to a head cover 20 made of metal which is provided with four opening portions 62 that correspond one-to-one to the head units 13. Furthermore, the head cover 20 is joined also to a lower surface of the second case 11 by an adhesive. Therefore, the head cover 20 and the seal member 18 seals a space in the second case 11.

Figure 9:
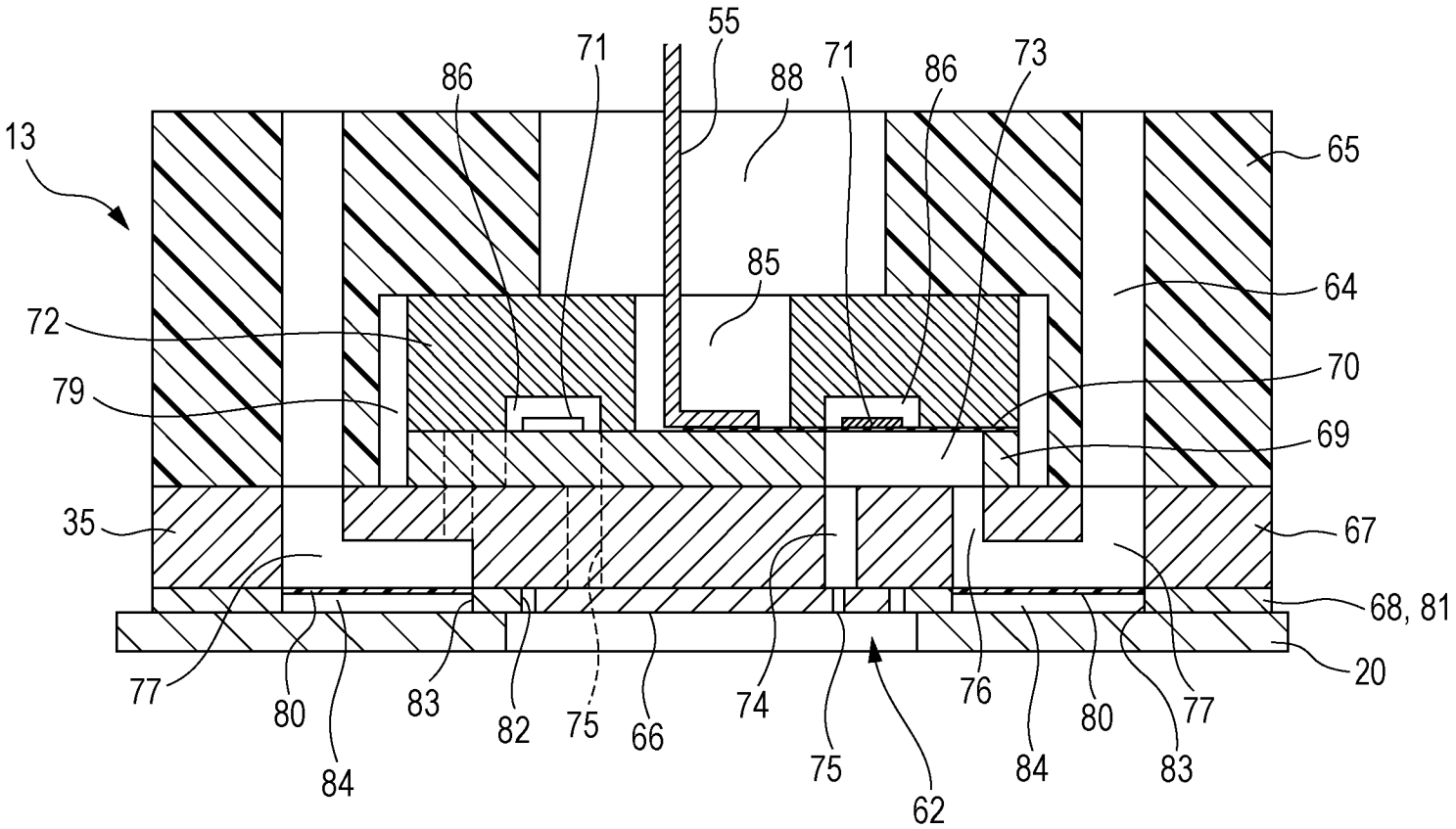
FIG. 9 is a sectional view of a head unit.

FIG. 9 is a sectional view of portions of a head unit 13 showing an internal construction thereof. In this exemplary embodiment, each head unit 13 is constructed by attaching a stack of a plurality of head unit component members to a head case 65 made of a synthetic resin. The head unit component members include a nozzle plate 66, the compliance substrate 68, a communication substrate 67, a pressure chamber-forming substrate 69, a vibration plate 70, piezoelectric elements 71 (kind of drive elements), a protective substrate 72, etc.

The pressure chamber-forming substrate 69 is manufactured from a silicon single-crystal substrate (hereinafter, also referred to simply as silicon substrate). The pressure chamber-forming substrate 69 is provided with a plurality of cavities for compartmentalizing pressure chambers 73. The cavities are formed by an anisotropic etching process. The cavities penetrate through the pressure chamber-forming substrate 69 in its thickness direction. An end opening portion of each cavity is sealed by the vibration plate 70 and the other end opening portion thereof is sealed by the communication substrate 67 to form a pressure chamber 73. Hereinafter, these cavities are also referred to as pressure chambers 73. In this exemplary embodiment, because the nozzle plate 66 of each head unit 13 is provided with two nozzle rows each of which is made up of a plurality of aligned nozzles 75, the pressure chamber-forming substrate 69 of each head unit 13 is provided with two rows of pressure chambers 73 corresponding to the two nozzle rows. Each pressure chamber 73 is a cavity elongated in a direction that interests (orthogonally intersects in this exemplary embodiment) the aligning direction of the nozzles 75 (nozzle row direction). When the pressure chamber-forming substrate 69 is positioned and joined to the communication substrate 67, an end portion of each pressure chamber 73 in its longitudinal direction communicates with a nozzle 75 via a corresponding one of nozzle communication paths 74 formed in the communication substrate 67. Furthermore, the other end portion of each pressure chamber 73 in its longitudinal direction communicates with a common liquid chamber 77 via a corresponding one of individual communication openings 76 formed in the communication substrate 67.

An upper surface of the pressure chamber-forming substrate 69 (a surface opposite to a joining surface with the communication substrate 67) is provided with the vibration plate 70 that is formed to seal the upper openings of the pressure chambers 73. This vibration plate 70 is formed from, for example, a silicon dioxide plate having a thickness of about 1 μm. An insulation film (not graphically shown) is formed on top of the vibration plate 70. This insulation film is made of, for example, zirconium oxide. The piezoelectric elements 71 are formed at locations in the vibration plate 70 and the insulation film which correspond to the pressure chambers 73. The piezoelectric elements 71 in this exemplary embodiment are so-called flexure mode piezoelectric elements. The piezoelectric elements 71 are formed separately for each pressure chamber 73 by sequentially stacking, on the vibration plate 70 and the insulation film, a lower electrode film made of a metal, a piezoelectric body layer made of a lead zirconate titanate (PZT) or the like, an upper electrode film made of a metal (none of which is graphically shown) and performing patterning. One of the upper electrode film and the lower electrode film is made a common electrode and the other is made individual electrodes. When a piezoelectric element 71 is driven, the vibration plate 70, the insulation film, and the lower electrode film function as a drive region.

Each piezoelectric element 71 has a lead electrode extending out to the vibration plate 70. One-end-side terminals of the flexible board 55 are connected to portions of the lead electrodes which correspond to electrode terminals. The flexible board 55 has a construction, for example, in which an electric conductor pattern is formed from copper foil or the like on a surface of a base film of a polyimide or the like and is coated with a resist. On a surface of the flexible board 55 there is mounted a drive IC 78 (see FIG. 3) that is provided to drive a corresponding one of the piezoelectric elements 71. Each piezoelectric element 71 produces flexure deformation when a drive signal (drive voltage) is selectively applied between the upper electrode film and the lower electrode film by the drive IC 78.

The communication substrate 67 joined to the lower surface of the pressure chamber-forming substrate 69 is a platy member manufactured from a silicon substrate similarly to the pressure chamber-forming substrate 69. The communication substrate 67 is provided with common liquid chambers 77 (referred to also as reservoirs of manifolds) that are cavities each of which is common to the pressure chambers 73 of a corresponding one of the pressure chamber rows. The common liquid chambers 77 are formed by anisotropic etching. The ink introduced through one of the introduction pins 22 flows down corresponding first case 10-side liquid flow paths, that is, sequentially flows through corresponding guide flow paths 31, filter chambers 24, and supply flow paths 33, passes through communication openings 34 of the second flow path member 15 and communication holes 37 of the seal member 18, and then flows down corresponding second case 11-side liquid flow paths, that is, sequentially through connection flow paths 36, introduction flow paths 50, and case flow paths 64, and then flows into corresponding common liquid chambers 77. The ink in the common liquid chambers 77 is supplied to the pressure chambers 73 through the individual communication openings 76 formed corresponding one-to-one to the pressure chambers 73.

The compliance substrate 68 is joined to a lower surface of the communication substrate 67. The compliance substrate 68 is a composite member made up of a thin compliance sheet 80 made of, for example, polyphenylene sulfide resin (PPS) or the like, and a sheet support plate 81 made of a metal which supports the compliance sheet 80. Regions in the sheet support plate 81 which face the common liquid chambers 77 are each provided with a compliance opening 83 formed by removing a portion of the sheet support plate 81 so that the compliance openings 83 have a shape similar to the shape of lower surface openings of the common liquid chambers 77. Therefore, the lower surface-side openings of the common liquid chambers 77 are sealed only by the compliance sheet 80 that has flexibility. In other words, the compliance sheet 80 compartmentalizes a portion of each common liquid chamber 77.

Portions of a lower surface of the sheet support plate 81 which correspond to the compliance openings 83 are sealed by the head cover 20. Therefore, the flexible regions of the compliance sheet 80 and the head cover 20 facing the flexible regions define therebetween compliance spaces 84. The flexible regions of the compliance sheet 80 which partially define the compliance spaces 84 are displaced to the common liquid chamber 77 side or to the compliance space 84 side according to pressure changes in the ink flow paths and particularly in the common liquid chambers 77. A central portion of the compliance substrate 68 is provided with a substrate opening portion 82 whose shape is similar to an external shape of the nozzle plate 66. That is, when the compliance substrate 68 and the nozzle plate 66 are joined to the communication substrate 67, the nozzle plate 66 is disposed in the substrate opening portion 82. The compliance sheet 80 may be made up of any sheet material, for example, a metal sheet, such as a very thin stainless steel sheet, if the compliance sheet 80 is a flexible member that can flex according to pressure changes in the ink flow path (common liquid chamber 77).

The protective substrate 72 is disposed on the upper surface of the pressure chamber-forming substrate 69 on which the piezoelectric elements 71 are formed. This protective substrate 72 is a hollow box-shaped member and is manufactured from, for example, a silicon substrate or the like. A central portion of the protective substrate 72 is provided with a wiring cavity 85 that penetrates the protective substrate 72 in the substrate thickness direction. In the wiring cavity 85 there are disposed connecting portions between the lead electrodes of the piezoelectric elements 71 and an end portion of the flexible board 55. Furthermore, regions in the protective substrate 72 which face the piezoelectric elements 71, more concretely, regions therein on both sides of the wiring cavity 85 in a direction orthogonal to the pressure chamber aligning direction, are provided with storage spaces 86 having such a size as not inhibit the driving of the piezoelectric elements 71. Each storage space 86 is formed from the lower surface of the protective substrate 72 (the joining surface with the pressure chamber-forming substrate 69) to an intermediate location in a substrate thickness direction to the upper surface side.

The nozzle plate 66 is a plate member provided with rows of nozzles 75 with a pitch corresponding to the dot formation density. The nozzle plate 66 has nozzle rows of a plurality of nozzles 75 aligned at a predetermined pitch. In this exemplary embodiment, the nozzle plate 66 of each head unit 13 has two nozzle rows. The two rows of nozzles of each one of the head units 13 are supplied with the same kind (color) of ink. In each set of two nozzle rows, the two nozzle rows are in a staggered arrangement in which the location of a given one of the nozzles 75 of one row in the nozzle row direction is different from the location of any adjacent one of the nozzles 75 of the other row. In this exemplary embodiment, the nozzle plates 66 are manufactured from a silicon substrate. By subjecting the substrate to dry etching, the hollow cylindrical nozzles 75 are formed. The longitudinal and lateral dimensions of the nozzle plate 66 are set smaller than the longitudinal and lateral dimensions of the substrate opening portion 82 of the compliance substrate 68 and the opening portion 62 of the head cover 20. When the nozzle plate 66 is positioned and joined to the communication substrate 67, the nozzle plate 66 is disposed in these opening portions 62 and 82. In this state, the nozzle communication paths 74 of the communication substrate 67 communicate with the nozzles 75.

The head case 65 is a box-shaped member made of a synthetic resin and a lower surface side thereof is joined to the communication substrate 67. A central portion of the head case 65 is provided with a through cavity 88 (a portion of the wiring space) that penetrates through the head case 65 in its height direction. The through cavity 88 communicates with the wiring cavity 85 of the protective substrate 72, forming a cavity in which the flexible board 55 is housed. A lower surface-side portion of the head case 65 is provided with the housing cavity 79 that recedes from the lower surface to an intermediate location in the height direction of the head case 65. This housing cavity 79 has such a size that, when the head case 65 and the communication substrate 67 are positioned and joined, the housing cavity 79 is capable of housing the pressure chamber-forming substrate 69 disposed on the communication substrate 67, the piezoelectric element 71, the protective substrate 72, etc. A lower end of the through cavity 88 has an opening in a ceiling surface of the housing cavity 79.

The head case 65 is provided with the case flow paths 64 that penetrate through the head case 65 in its height direction. The case flow paths 64 are formed at locations apart from the housing cavity 79 of the head case 65 outward in a direction orthogonal to the pressure chamber aligning direction. More concretely, a total of two case flow paths 64 are formed at both sides of the housing cavity 79, that is, one case flow path 64 on each side, corresponding to the common liquid chambers 77 of the communication substrate 67. When the communication substrate 67 is joined to the head case 65, each case flow path 64 communicates with a corresponding one of the common liquid chambers 77.

The head cover 20 is, for example, a plate member made of a metal such as a stainless steel. In this exemplary embodiment, in order to expose the nozzles 75 formed in the nozzle plates 66, portions of the head cover 20 which correspond in position to the nozzle plates 66 are provided, as described above, with the opening portions 62 whose shape is similar to the external shape of the nozzle plates 66 and which penetrate through the head cover 20 in its thickness direction. In this exemplary embodiment, the lower surface of the head cover 20 and the portions of the nozzle plates 66 exposed through the opening portions 62 of the head cover 20 form a nozzle surface.

In the recording head 3 constructed as described above, during a state in which the flow paths extending from the common liquid chambers 77 to the nozzles 75 through pressure chambers 73 are filled with ink, piezoelectric elements 71 are driven according to the drive signals from the drive ICs 78, so that ink in corresponding ones of the pressure chambers 73 undergoes pressure changes and, due to the pressure changes, the corresponding nozzles 75 eject ink.

Thus, in the recording head 3 according to the invention, because the flow path member 9 is disposed in the sealed space 12 that is defined in the first case 10 as the first case 10 is joined to the second flow path member 15 that is a flow path-isolating member having high gas barrier property, that is, because the sealed space 12 is formed from a material having high gas barrier property, the evaporation of moisture (solvent component) of ink in the liquid flow paths of the flow path member 9 disposed in the sealed space 12 is inhibited. The thickening (viscosity increase) of ink in the liquid flow paths in the flow path member 9 is inhibited. Furthermore, according to this construction, since the thickening of ink in the flow path member 9 is inhibited, changes in ink ejection characteristics, such as the weight of ink ejected from the nozzles 75 and the flying speed of ejected ink, caused by the thickening of ink are inhibited. Therefore, the reliability of the printer 1 improves. Furthermore, in the printer 1, it is possible to reduce the amount of ink consumed in a maintenance operation of discharging thickened ink from the nozzles 75 by performing ink suction while having the nozzle surface of the recording head 3 sealed by the cap 6'.

Furthermore, since one of the flow path component members of the flow path member 9 is the second flow path member 15 that functions also as a flow path-isolating member, it is unnecessary to provide a flow path-isolating member separately from the flow path component members and therefore it becomes possible to reduce the size of the recording head 3. The material cost can also be reduced.

Furthermore, in the exemplary embodiment, since the sealed space 12 is defined as the first case 10 having higher gas barrier property compared to the seal member 18 is joined to the second flow path member 15, the evaporation of moisture of ink in the liquid flow paths of the flow path member 9 disposed in the sealed space 12 is inhibited.

By the way, the invention is not limited to the foregoing exemplary embodiments but may be modified or changed in various manners based on what are described in the appended claims.

Figure 10:
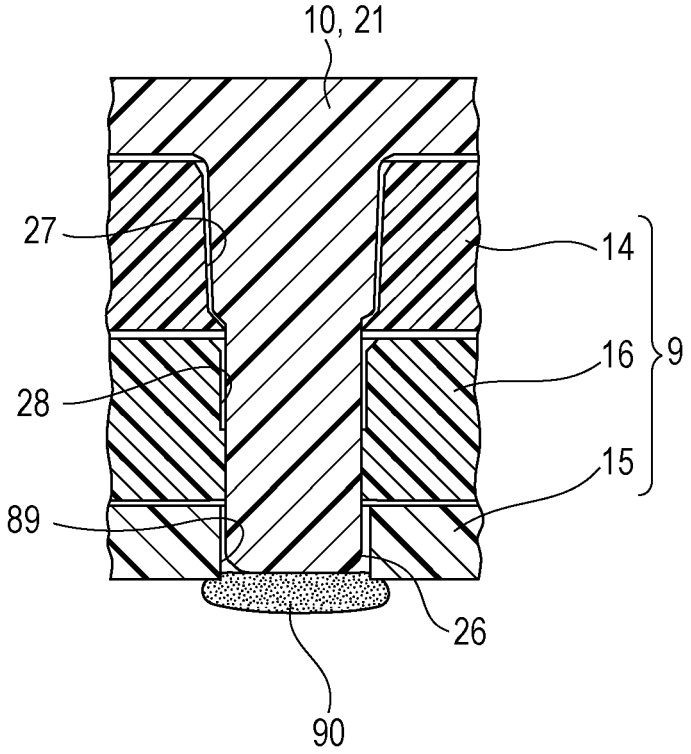
FIG. 10 is a sectional view of a positioning pin and its surroundings in a second exemplary embodiment of the invention.

FIG. 10 is a sectional view of a positioning pin and portions around the positioning pin in a second exemplary embodiment. In the first exemplary embodiment, of the flow path component members of the flow path member 9, the second flow path member 15 that functions also as a flow path-isolating member is provided with the positioning recess portions 29 into which distal end portions of the positioning pins 26 can be fitted, and the positioning pins 26 are covered with the first flow path member 14, the filter substrate 16, and the second flow path member 15 when the positioning pins 26 are disposed in the sealed space 12. However, the invention is not limited to this construction. A second flow path member 15 in the second exemplary embodiment similarly to the first flow path member 14 and the filter substrate 16, is provided with positioning holes 89 (that correspond to an insertion hole in the invention) through which the positioning pins 26 can be inserted and which penetrates the second flow path member 15 in its plate thickness direction. The positioning pins 26 are inserted through the positioning holes 27, 28 and 89 of these flow path component members and distal end portions of the positioning pins 26 in the positioning holes 89 of the second flow path member 15 are exposed to an outer side of the flow path member 9 (to the lower surface side of the second flow path member 15). In this exemplary embodiment, the distal end portions of the positioning pins 26 exposed in the positioning holes 89 are sealed by a sealer 90 such as an epoxy-based adhesive. Thus, the positioning pins 26 are covered by the first flow path member 14, the filter substrate 16, the second flow path member 15, and the sealer 90 when the positioning pins 26 are disposed in the sealed space 12. Therefore, the sealed space 12 is prevented from communicating with the atmosphere via the positioning holes 27, 28 and 89 through which the positioning pins 26 are inserted, so that it becomes possible to position the flow path component members by the positioning pins while securing gas tightness and liquid tightness of the sealed space 12. Incidentally, other constructions of the second exemplary embodiment are the same as those of the first exemplary embodiment.

Furthermore, although the foregoing exemplary embodiments having described above in conjunction with an example construction in which the resistance pathway in the atmospherically open passageway is formed by the outside wall 51 of the seal member 18 closely contacting the groove 41 formed in the second flow path member 15, the invention is not limited to this construction. For example, a resistance pathway may be formed by joining flow path component members. In this case, for example, if at least one of the flow path component members is provided with a groove similar to the groove 41, the resistance pathway can be defined by joining the grooved flow path component member to the other flow path component member with an adhesive so that the opening of the groove is sealed. According to this construction, as the resistance pathway is formed by joining flow path component members that are high in gas barrier property, the evaporation of moisture from the resistance pathway is further reduced.

Furthermore, although the foregoing exemplary embodiments show the first flow path member 14, the filter substrate 16, and the second flow path member 15 as examples of the flow path component members that constitute the flow path member 9, this construction does not restrict the invention. In short, a construction that includes at least one flow path component member and a flow path-isolating member suffices.

Although the foregoing description has presented the ink jet type recording head 3 (head units 13) as an example of a liquid ejecting head, the invention can also be applied to other liquid ejecting heads that include flow path members. For example, the invention is also applicable to color material ejecting heads for use in production of color filters for liquid crystal displays and the like, electrode material ejecting heads for use in electrode formation for organic electro-luminescence (EL) displays, field emission displays (flat panel displays), etc., bioorganic material ejecting heads for use in production of biochips (biochemical devices), and so forth.

The entire disclosure of Japanese Patent Application No. 2016-035216, filed Feb. 26, 2016 and Japanese Patent Application No. 2017-007224, filed Jan. 19, 2017 are expressly incorporated by reference herein.

What is claimed is:

1. A liquid ejecting head comprising:

a first case that houses a flow path member that is provided with a liquid flow path;

a second case that is provided with a liquid flow path and includes a head unit having a nozzle from which a liquid supplied from the flow path member ejects;

a seal member that includes a connecting portion that seals and liquid-tightly connects the liquid flow path on a first case side and the liquid flow path on a second case side;

a flow path-isolating member having higher gas barrier property than the seal member, the flow path-isolating member is disposed between the first case and the seal member; and a sealed space in which the flow path member is disposed, the sealed space is defined in the first case by a flow path-isolating member being joined to the first case.

2. The liquid ejecting head according to claim 1, wherein the first case has higher gas barrier property than the seal member.

3. The liquid ejecting head according to claim 1, wherein the seal member has an outside wall along an outer perimeter of the seal member, and a space in which the connecting portion is disposed is sealed by placing the outside wall in close contact with the flow path-isolating member and a component member on the second case side.

4. The liquid ejecting head according to claim 3, wherein a portion of the flow path-isolating member which contacts the outside wall of the seal member is provided with a groove extending along the outer perimeter, and a resistance pathway is formed by the portion having contact with the outside wall, and wherein the resistance pathway communicates with the sealed space and also communicates with an atmospherically open path that connects to an atmosphere.

5. The liquid ejecting head according to claim 1, wherein the first case includes a positioning pin that defines a position at which the flow path member is disposed, and wherein the flow path member has an insertion hole into which the positioning pin is inserted, wherein the flow path-isolating member has a recess portion into which a distal end portion of the positioning pin fits, and wherein the positioning pin is covered by the flow path member and the flow path-isolating member and disposed in the sealed space by inserting the positioning pin through the insertion hole and fitting the positioning pin into the recess portion.

6. The liquid ejecting head according to claim 1, wherein the first case has a positioning pin that defines a position at which the flow path member is disposed, wherein the flow path member and the flow path-isolating member each has an insertion hole into which the positioning pin is inserted, and wherein the positioning pin is inserted in the insertion hole and disposed in the sealed space, and a distal end portion of the positioning pin exposed via the insertion hole is sealed by a sealer.

7. The liquid ejecting head according to claim 1, wherein the flow path member is formed by stacking a plurality of flow path component members, and wherein one of the flow path component members is the flow path-isolating member.

8. A liquid ejecting apparatus comprising the liquid ejecting head according to claim 1.

9. A liquid ejecting apparatus comprising the liquid ejecting head according to claim 2.

10. A liquid ejecting apparatus comprising the liquid ejecting head according to claim 3.

11. A liquid ejecting apparatus comprising the liquid ejecting head according to claim 4.

12. A liquid ejecting apparatus comprising the liquid ejecting head according to claim 5.

13. A liquid ejecting apparatus comprising the liquid ejecting head according to claim 6.

14. A liquid ejecting apparatus comprising the liquid ejecting head according to claim 7.

* * * * *